US005100335A

United States Patent [19]

Yamamoto

[11] Patent Number: 5,100,335

[45] Date of Patent: Mar. 31, 1992

[54] SEALED ELECTRICAL CONNECTOR AND SEAL RING THEREFOR

[75] Inventor: Masahiro Yamamoto, Kanagawa, Japan

[73] Assignee: Thomas & Betts Corporation, Bridgewater, N.J.

[21] Appl. No.: 741,300

[22] Filed: Aug. 7, 1991

Related U.S. Application Data

[63] Continuation of Ser. No. 646,584, Jan. 28, 1991, abandoned.

[51] Int. Cl.[5] ..... H01R 13/00

[52] U.S. Cl. ..... 439/271

[58] Field of Search ..... 439/271-282

[56] References Cited

U.S. PATENT DOCUMENTS

| | | | |
|---|---|---|---|
| 4,214,802 | 7/1980 | Otani et al. | 439/275 |
| 4,621,883 | 11/1986 | Noguchi | 339/60 M |
| 4,874,325 | 10/1989 | Bensing et al. | 439/272 |
| 4,932,875 | 6/1990 | Ogawa et al. | 439/271 |

FOREIGN PATENT DOCUMENTS

| | | |
|---|---|---|
| 0132099 | 1/1985 | European Pat. Off. . |
| 0335721 | 10/1989 | European Pat. Off. . |
| 55-31201 | 2/1980 | Japan . |
| 56-14482 | 2/1981 | Japan . |
| 1-51031 | 11/1989 | Japan . |
| 2216736 | 10/1989 | United Kingdom . |

*Primary Examiner*—Joseph H. McGlynn

*Attorney, Agent, or Firm*—Robert M. Rodrick; Salvatore J. Abbruzzese

[57] ABSTRACT

A sealed electrical connector comprises a male housing and a female housing with a seal ring disposed in a cavity in the female housing. The seal ring comprises a rubber ring body having projecting ribs on an outer peripheral surface thereof and a plurality of projecting ribs on an inner peripheral surface thereof. Around the circumference of the ring body and projecting thereinto are a plurality of locking grooves. The locking grooves are positioned to correspond with a like plurality of latch projections extending upwardly from a bottom wall in the female cavity and in engagement with the seal ring grooves.

7 Claims, 2 Drawing Sheets

SEALED ELECTRICAL CONNECTOR AND SEAL RING THEREFOR

This is a continuation of application Ser. No. 07/646,584, filed Jan. 28, 1991, now abandoned.

FIELD OF THE INVENTION

The present invention relates to a seal ring and a sealed electrical connector using same.

BACKGROUND OF THE INVENTION

In a waterproof electrical connector having male and female housings, a seal ring for sealing the male and female housings is generally mounted on the outer surface of the male housing, and the resultant structure is inserted into the female housing.

In such structure, since the seal ring is exposed on the outer surface of the male housing, the seal ring may be susceptible to external influences. For example, the seal ring may be damaged during assembly, thus impairing the waterproof properties. In order to solve this problem, a waterproof connector having a cylindrical outer wall for protecting a seal ring on a male housing is known (Japanese Publication No. 1-51031, corresponding to U.S. Pat. No. 4,621,883, issued on Nov. 11, 1986). In this connector, however, the male housing has a relatively high profile, and the connector is bulky, resulting in inconvenience.

In order to protect the seal ring and provide a compact connector, an assembly obtained by mounting a seal ring on the inner wall surface of a female housing is also known (Japanese Laid-Open Utility Model Application No. 55-31201). In this case, unless the male housing is inserted into the female housing with care, the seal ring may be folded, removed, or deformed, thereby greatly impairing the waterproofing effect.

SUMMARY OF THE INVENTION

It is therefore an object of the present invention to reduce the conventional drawbacks described above, and to implement a new structure of a seal ring and a new structure of a connector housing mounted with the seal ring, to thereby prevent degradation of the sealing effect at the time of assembly of the connector.

DETAILED DESCRIPTION OF THE PREFERRED EMBODIMENT

Figure 1:
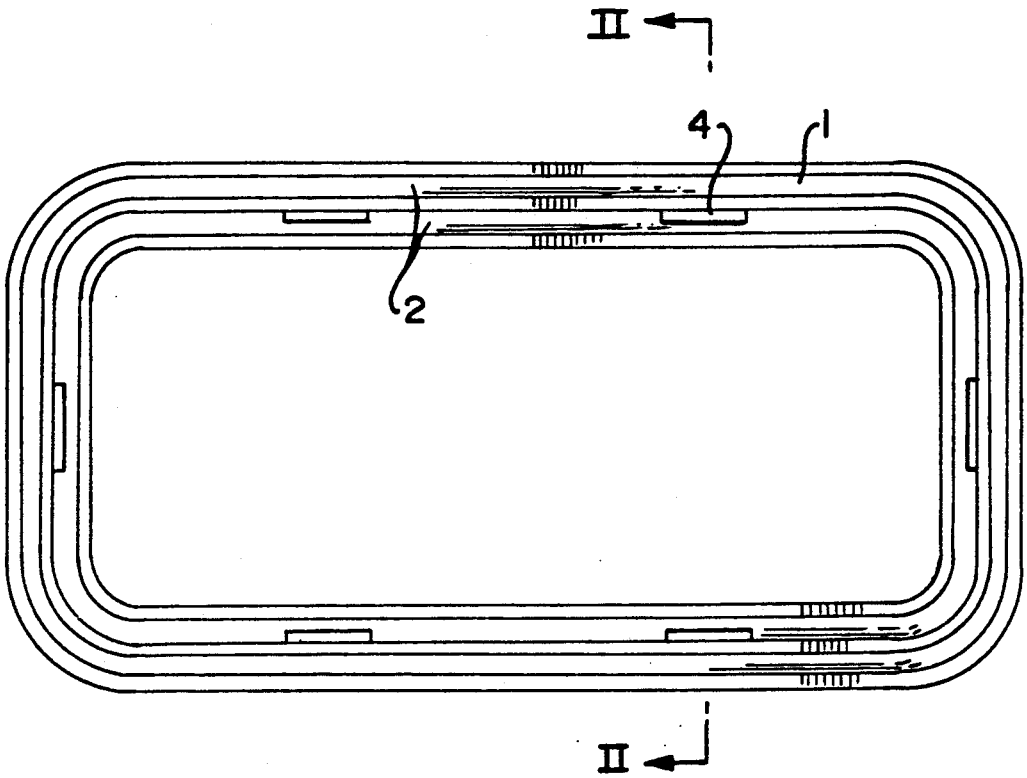
FIG. 1 is a plan view showing an arrangement of a seal ring according to the present invention.
Figure 2:
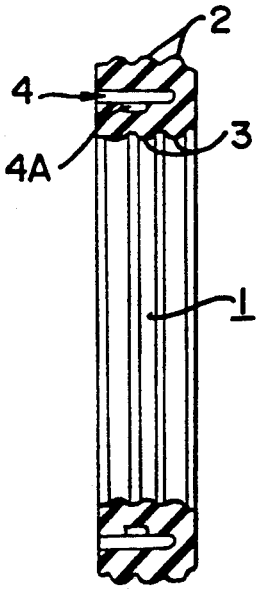
FIG. 2 is a sectional view of the seal ring of FIG. 1, as seen along viewing lines II—II.

A seal ring according to the present invention is shown in FIGS. 1 and 2.

Referring to FIGS. 1 and 2, the seal ring comprises a rubber ring body 1, projections, such as ribs 2, formed on the outer peripheral surface of the ring body, and projections, such as ribs 3, formed on the inner peripheral surface of the ring body. A locking groove 4 is formed into the ring body and between the projections 2 and 3. In the illustrated embodiment, a total of six locking grooves are formed along the circumference of the seal ring.

Since these locking grooves 4 are to be respectively engaged with latch projections 12 (see FIG. 3) formed in a cavity of a female housing 11 for receiving a male housing 10, the locking grooves 4 are formed at positions respectively corresponding to the latch projections, as will be indicated hereinbelow.

The locking groove 4 has a groove 4A extending in a direction perpendicular to the direction of depth of the locking groove 4. The groove 4A corresponds to a projection 12A (see FIG. 3) extending from the corresponding latch projection 12 formed in the cavity of the female housing 11.

In the illustrated embodiment, the projections 2 and 3 are formed at substantially corresponding, opposite positions.

Figure 3:
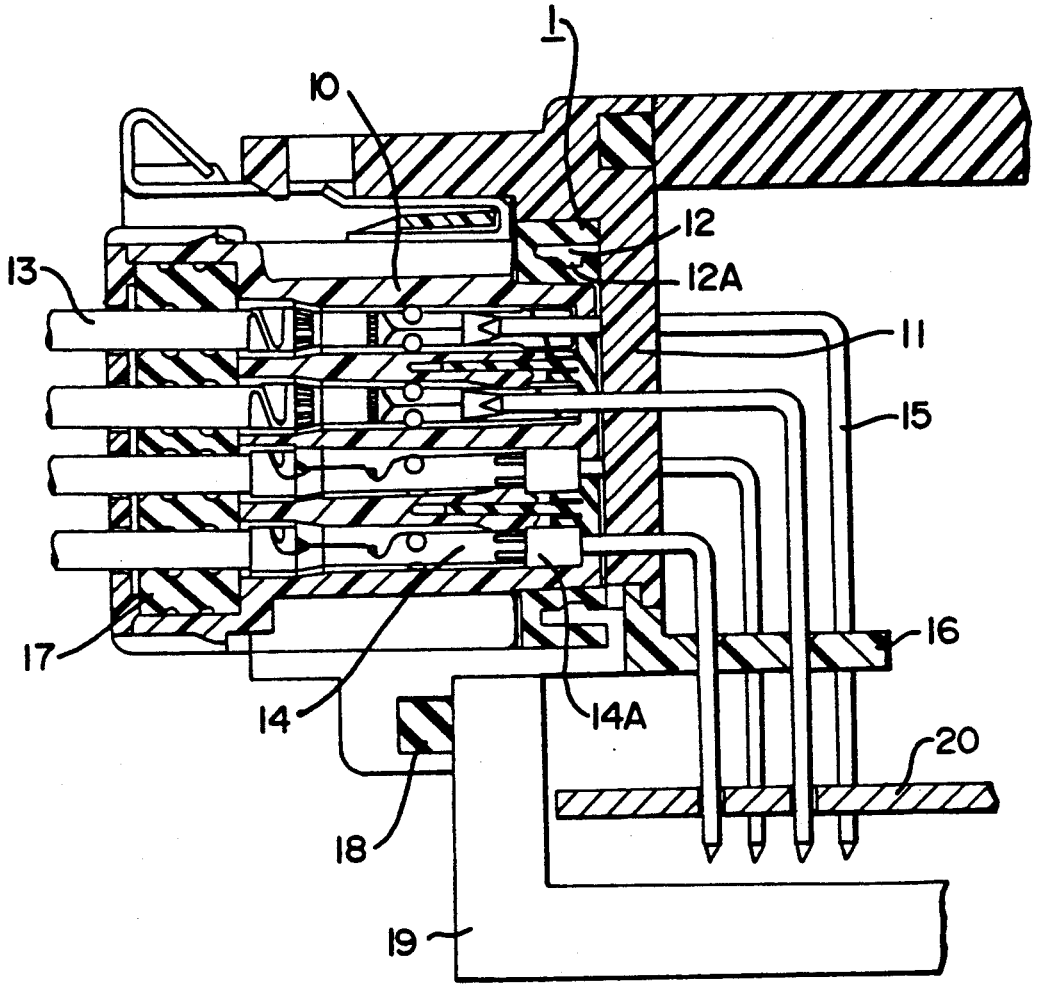
FIG. 3 is a sectional view showing an arrangement of an electrical connector according to the present invention, using the seal ring of FIG. 1.

FIG. 3 shows a sealed connector including the seal ring described above.

The connector comprises a male housing 10, a female housing 11 having a cavity for receiving the male housing 10, and the seal ring.

The grooves 4 on the seal ring are engaged with the latch projections 12 extending from the bottom surface of the cavity of the female housing 11. As shown in FIG. 3, the seal ring is interposed between an outer wall surface of the male housing and an inner wall surface of the female housing to seal the male and female housings when the male and female housings are joined with each other.

Referring still to FIG. 3, reference numeral 13 denotes wires each having a distal end terminating at a corresponding receptacle contact 14. A ferrule 14A (crown-shaped cap) is mounted on the distal end of the receptacle contact. A pin contact 15 is received into the corresponding receptacle contact through the corresponding ferrule.

Each pin contact extends through the bottom portion of the cavity of the female housing 11. In the illustrated structure, the pin contact extending through the housing is inserted into and fixed on a printed circuit board 20 through an alignment plate 16.

Reference numeral 17 denotes a bushing having a plurality of holes for receiving the wires 13. The bushing 17 serves to seal the wires 13 and the male housing 10. Reference numeral 18 denotes a packing rubber member and reference numeral 19, a unit case.

Since the seal ring according to the present invention has the locking grooves which are respectively engaged with the latch projections formed on the bottom of the cavity of the female housing, the seal ring is not inadvertently folded or the like when the male housing is fitted in the cavity of the female housing. Therefore, the sealing effect is not impaired.

Since the seal ring is fixed in the cavity of the female housing, the seal ring tends not to adversely affected externally. A special structure for protecting the seal ring (e.g., a cylindrical outer wall for protecting the seal ring in a known connector) is not required, thereby providing a compact structure.

Since each locking groove of the seal ring of the present device has a groove extending in a direction perpendicular to the direction of depth of the locking groove, the seal ring is not easily removed from the latch projections.

Having described the preferred embodiment of the present invention herein, it should be understood that variations may be made thereto without departing from the contemplated scope. Accordingly, the description of the preferred embodiment is intended to be illustrative rather than limiting. The true scope of the invention is set forth in the claims appended hereto.

I claim:

1. A connector seal ring comprising an elastomeric ring body (1), at least one projection (2) formed on an outer peripheral surface of said ring body, at least one projection (3) formed on an inner peripheral surface of said ring body, and a locking groove (4) extending into said ring body and between said projections (2) and (3).

2. A connector seal ring according to claim 1, wherein said projections (2) and (3) extend in substantially opposite directions and wherein said locking groove (4) extends into said ring body (1) in a direction generally perpendicular to the direction of the projections (2) and (3).

3. A seal ring according to claim 2, wherein said locking groove (4) has a groove (4A) communicating therewith and formed in a direction generally perpendicular to the direction of depth of said locking groove (4).

4. A seal ring according to claim 3, wherein said projections (2) and (3) are formed at substantially corresponding opposite positions.

5. A sealed connector comprising a male housing (10), a female housing (11) having a cavity receiving sale male housing, and a seal ring according to claim 1, wherein said seal ring is disposed in said cavity and interposed between an outer wall surface of said male housing and an inner wall surface of said female housing when said male and female housings are joined with each other.

6. A sealed connector according to claim 5, wherein said locking groove (4) is formed to correspond to a latch projection (12) on said female housing (11) and projecting into said cavity such that said locking groove (4) engages with said latch projection (12).

7. A sealed connector according to claim 6, wherein said seal ring (1) is disposed on a surface of said female housing, said projection (2) being in interference fit with said female housing surface for holding said ring thereon.

* * * * *